US009268281B2

(12) United States Patent
Saito

(10) Patent No.: US 9,268,281 B2
(45) Date of Patent: Feb. 23, 2016

(54) IMAGE FORMING APPARATUS

(71) Applicant: CANON KABUSHIKI KAISHA, Tokyo (JP)

(72) Inventor: Makoto Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/510,285

(22) Filed: Oct. 9, 2014

(65) Prior Publication Data

US 2015/0117878 A1 Apr. 30, 2015

(30) Foreign Application Priority Data

Oct. 24, 2013 (JP) ..... 2013-220921

(51) Int. Cl.
*G03G 15/08* (2006.01)
*G03G 15/00* (2006.01)
*G03G 15/043* (2006.01)

(52) U.S. Cl.
CPC ..... *G03G 15/5025* (2013.01); *G03G 15/043* (2013.01); *G03G 15/5041* (2013.01); *G03G 15/5058* (2013.01); *G03G 15/75* (2013.01); *G03G 2215/00029* (2013.01)

(58) Field of Classification Search
CPC ..... G03G 15/5025; G03G 15/5041; G03G 15/75; G03G 2215/00029; G03G 15/043; G03G 15/5058
See application file for complete search history.

(56) References Cited

U.S. PATENT DOCUMENTS 5,315,351 A 5/1994 Matsushiro et al.
5,574,543 A * 11/1996 Sakai et al. ..... 399/59
5,737,663 A * 4/1998 Handa et al. ..... 399/50
5,749,022 A * 5/1998 Kikui et al. ..... 399/50
6,070,022 A * 5/2000 Kobayashi et al. ..... 399/12
6,167,212 A 12/2000 Satoh et al.
6,272,306 B1 8/2001 Saito et al.
6,904,245 B2 6/2005 Mochizuki et al.
6,990,300 B2 1/2006 Saito et al.
7,006,774 B2 2/2006 Saito et al.
7,050,733 B2 5/2006 Saito et al.
2004/0081477 A1 * 4/2004 Maebashi et al. ..... 399/49

(Continued)

FOREIGN PATENT DOCUMENTS

JP 04195172 A * 7/1992
JP 2001109205 A 4/2001

(Continued)

*Primary Examiner* — Ryan Walsh

(74) *Attorney, Agent, or Firm* — Fitzpatrick, Cella, Harper & Scinto

(57) ABSTRACT

An image forming apparatus includes a photosensitive member, a developing portion to develop an electrostatic image on the photosensitive member, and a sensor to detect a toner image formed by the developing portion to output density information depending on a toner amount per unit area. A controller controls a supply of developer on the basis of a detection result of a supply control toner image. The controller adjusts an exposure condition for forming the supply control toner image by the exposure portion after exchange of the photosensitive member on the basis of first information and second information. The first information is a detection result when a first control toner image, formed before an exchange of the photosensitive member, is detected by the sensor, and the second information is a detection result when a second control toner image, formed after the exchange of the photosensitive member, is detected by the sensor.

7 Claims, 10 Drawing Sheets

(56) References Cited

U.S. PATENT DOCUMENTS

| | | | | |
|---|---|---|---|---|
| 2004/0208661 | A1* | 10/2004 | Kitagawa | G03G 15/5058 399/49 |
| 2005/0281575 | A1* | 12/2005 | Yoshizuka et al. | 399/55 |
| 2009/0110425 | A1* | 4/2009 | Uno et al. | 399/61 |
| 2010/0290799 | A1* | 11/2010 | Komiya | G03G 15/5033 399/49 |
| 2011/0103815 | A1 | 5/2011 | Hanashi | |

FOREIGN PATENT DOCUMENTS

| | | | |
|---|---|---|---|
| JP | 2005189493 | A | 7/2005 |
| JP | 2012226169 | A | 11/2012 |

* cited by examiner (a)

(b)

IMAGE FORMING APPARATUS

FIELD OF THE INVENTION AND RELATED ART

The present invention relates to an image forming apparatus such as a copying machine, a printer, a facsimile machine or a multi-function machine having a plurality of functions of these machines.

The image forming apparatus in which an electrostatic image formed on a photosensitive drum as a photosensitive member is developed with a two-component developer containing a toner and a carrier to form a toner image and then after the formed toner image is transferred onto a sheet, an image is fixed on the sheet by subjecting the sheet to heating has been used widely. In such an image forming apparatus using the two-component developer, a T/D ratio (a ratio of the toner weight to a total weight of the toner and the carrier) is decreased by toner consumption during development, so that there is a tendency to increase a toner charge amount. When the toner charge amount increases, an image density lowers, and therefore the toner is supplied depending on the toner consumption. There is also a case where a developing characteristic such as a charging property of the developer changes depending on an operational period or an operational environment and thus a toner density is deviated from a desired density. For this reason, a so-called ATR (Automatic Toner Replenishment) patch control in which a patch image (supply control toner image) is formed and a toner amount per unit area thereof is detected and then a toner supply amount is controlled depending on a change in toner amount per unit area has been conventionally known (Japanese Laid-Open Patent Application (JP-A) 2001-109205).

In the above ATR patch control, e.g., an electrostatic image is formed by an exposure device and then is developed to form the patch image. Further, in the ATR patch control, the patch image is formed under a predetermined contrast condition in an initial state of the developer, and an image density of the patch image is stored as a target (image density). Then, when the ATR patch control is effected, the density of the patch image at that time and the patch image density stored as the target are compared with each other, and then the toner supply amount is controlled.

On the other hand, in recent years, in order to reduce a cost of exchange (replacement) parts of the image forming apparatus, there is a case where the photosensitive drum and a developing device as a developing portion are separately exchanged (replaced). For this reason, there is a case where only the photosensitive drum is exchanged, but the developing device is not exchanged. In this case, there is a possibility that accuracy of the ATR patch control lowers. This reason will be described below.

The photosensitive drum has a difference among individuals in drum sensitivity as a potential shift amount relative to an exposure amount, and therefore when the photosensitive drum is exchanged, the exposure amount for obtaining the same latent image contrast is different in some cases. On the other hand, the developing device is not exchanged, and therefore the developing characteristic of the developer is not changed even when the photosensitive drum is exchanged. Accordingly, in the case where the ATR patch control is carried out using the photosensitive drum after the exchange under a condition before the exchange of the photosensitive drum, although the developing characteristic of the developer does not change, the patch image density causes deviation due to the difference in drum sensitivity between the photosensitive drums before and after the exchange.

Then, in such a state in which the deviation generates in patch image density, in the case where the patch image density is compared with a patch image density (target) formed in an initial state of a developer in a developing device which has not been exchanged, proper toner supply control cannot be carried out. As a result, by the exchange of the photosensitive drum, accuracy of the ATR patch control lowers.

SUMMARY OF THE INVENTION

In view of the above-described circumstances, a principal object of the present invention is to provide an image forming apparatus capable of suppressing a lowering in accuracy of ATR patch control even in the case where a photosensitive member is exchanged with no exchange of a developing portion.

According to an aspect of the present invention, there is provided an image forming apparatus comprising: a photosensitive member; an exposure portion for exposing the photosensitive member to light to form an electrostatic image; a developing portion for developing the electrostatic image on the photosensitive member with a developer containing a toner and a carrier; a sensor for detecting a toner image formed by the developing portion to output density information depending on a toner amount per unit area; a supply portion for supplying the developer to the developing portion; a controller for controlling an amount of the developer, to be supplied from the supply portion, on the basis of the density information, wherein the density information is outputted from the sensor after an electrostatic image for a supply control toner image is exposed to light by the exposure portion under an exposure condition for supply control and then is developed by the developing portion into the supply control toner image, which is then detected by the sensor; a storing portion for storing the density information outputted from the sensor; and an exchange detecting portion for detecting information for discriminating exchange of the photosensitive member, wherein the controller is capable of executing an operation in a mode, in which the exposure condition for the supply control is adjusted, on the basis of the information detected by the exchange detecting portion, and wherein in the mode, the exposure condition for the supply control is controlled on the basis of the information stored in the storing portion and a detection result of a control toner image, which is formed during the operation in the mode, detected by the sensor.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described specifically with reference to the drawings.

<Embodiment 1>

(Image Forming Apparatus)

Figure 1:
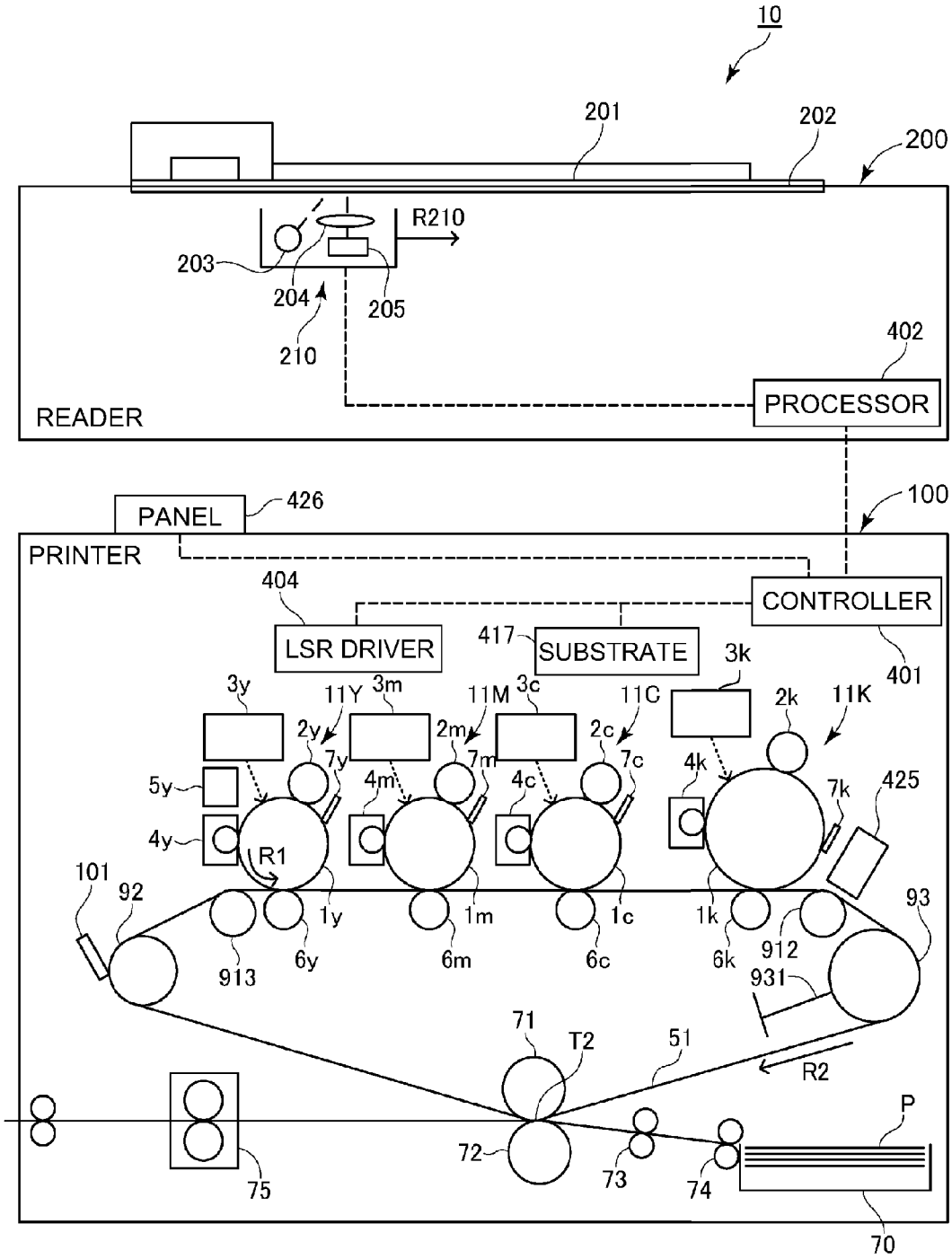
FIG. 1 is an illustration of a structure of an image forming apparatus.
Figure 2:
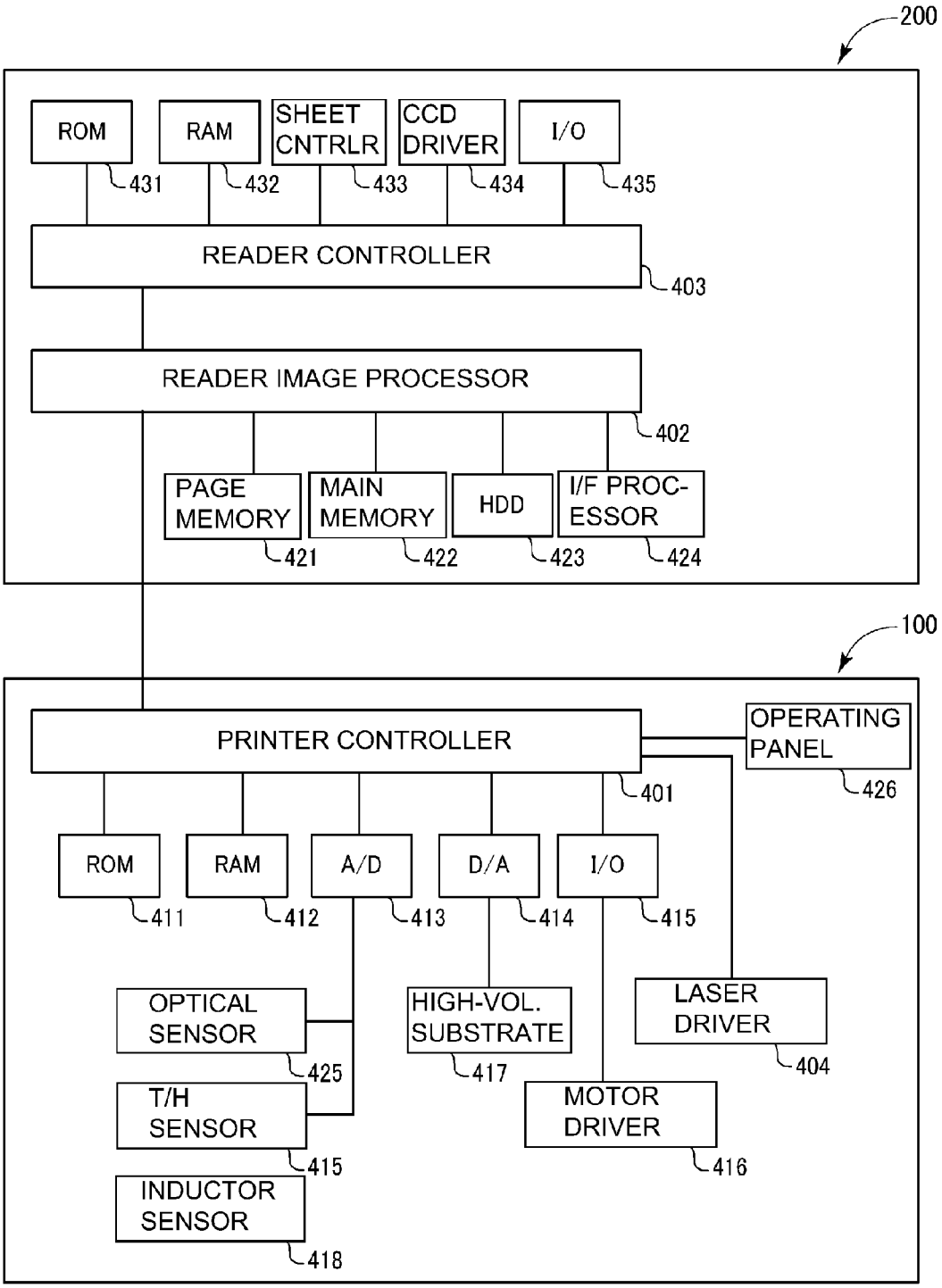
FIG. 2 is an illustration of a control system of the image forming apparatus.
Figure 3:
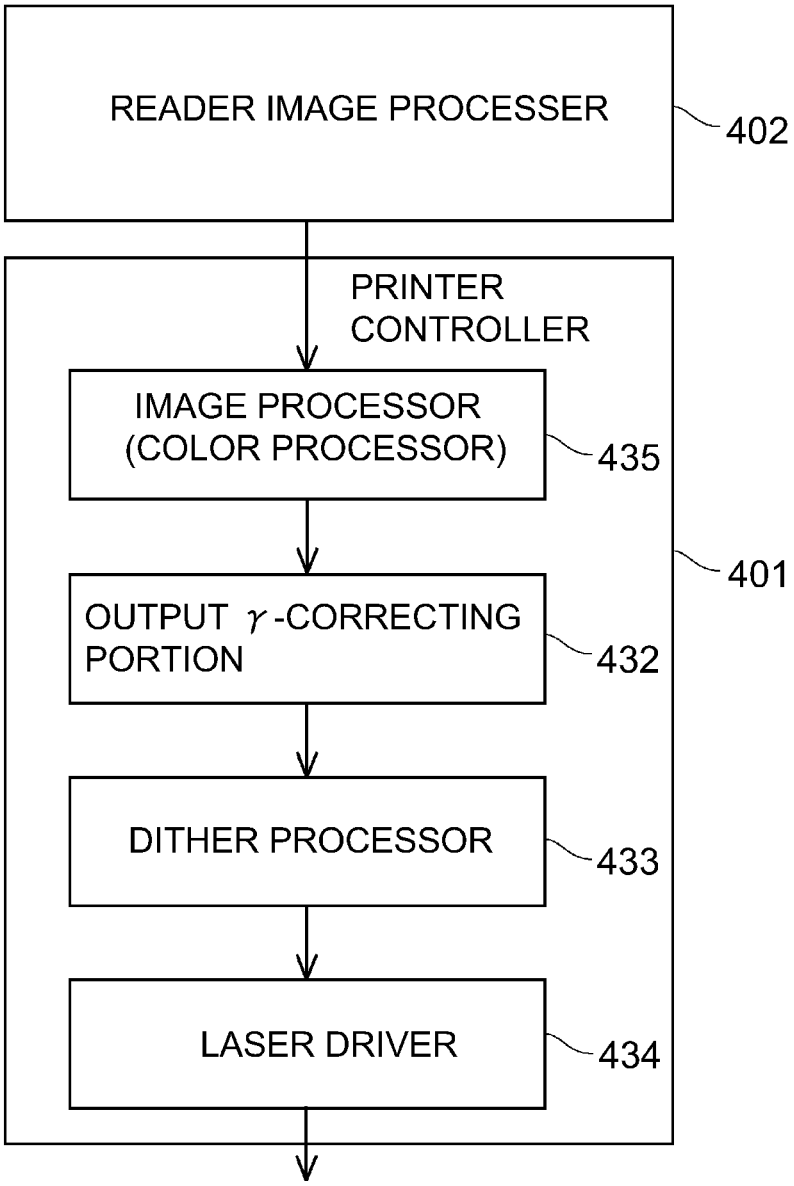
FIG. 3 is a block diagram of a structure of a printer controller.

FIG. 1 is an illustration of a structure of an image forming apparatus. FIG. 2 is an illustration of a control system of the image forming apparatus. FIG. 3 is a block diagram of a structure of a printer controller.

As shown in FIG. 1, a printer portion 100 is an intermediary transfer type full color printer of a tandem type in which image forming portions 11Y, 11M, 11C and 11K are arranged along an intermediary transfer belt 51 which is an example of an intermediary transfer member.

At the image forming portion 11*y*, a yellow toner image is formed on a photosensitive drum 1Y as a photosensitive member and then is transferred onto the intermediary transfer belt 51. At the image forming portion 11*m*, a magenta toner image is formed on a photosensitive drum 1M and then is transferred onto the intermediary transfer belt 51. At the image forming portions 30C and 30K, cyan and black toner images are formed on photosensitive drums 11*c* and 11*k*, respectively, and then are transferred onto the intermediary transfer belt 51.

The four color toner images transferred on the intermediary transfer belt 51 are conveyed to a secondary transfer portion T2 and are secondary-transferred onto a sheet P. A separation roller 74 separates sheets P, one by one, pulled out from a cassette 70, and then feeds the sheet S to a registration roller pair 73. The registration roller pair 73 sends the sheet S to the secondary transfer portion T2 while being timed to the toner images on the intermediary transfer belt 51. The sheet P on which the four color toner images are secondary-transferred is pressed and heated by a fixing device 75, so that the toner images are fixed on a surface of the recording material S.

(Reader Portion)

An image forming apparatus 10 includes a reader portion 200 provided above the printer portion 100. The reader portion 200 is an image reader (flat-head image scanner) provided with an automatic original feeding mechanism. The reader portion 200 reads an image on a downward surface of an original 201 placed on an original supporting plate 202 by moving a reading head 210 in an arrow R210 direction.

The reading head 210 is constituted by an optical source 203, an optical system 204, a CCD sensor 205 and the like. Reflected light from the original irradiated with light from the light source 203 is focused on the CCD sensor 205 via the optical system 204. The CCD sensor 205 detects brightness values of RGB for each of reading scanning lines. The brightness values are converted into density data of 8 bit by using a density value conversion table for converting the brightness values into density values. Image data described in the form of the density data are converted into a full-color image data for one sheet (page) by a reader image processor 402, and thereafter the full-color image data is sent to a printer controller 401 of the printer portion 100.

As shown in FIG. 2, the printer controller 401 divides the full-color image data into CMYK image data, and develops the CMYK image data into a scanning line image signal, corresponding to an image density, along a scanning line for scanning exposure. The printer controller 401 is capable of processing not only the image data read at the reader portion 200 but also image data received via a telephone line or a network in a similar manner.

(Image Forming Portion)

As shown in FIG. 1, the image forming portions 11Y, 11M, 11C and 11K have the same constitution except that colors of toners used in developing devices 4*y*, 4*n*, 4*c* and 4*k*, respectively, are yellow, magenta, cyan and black, respectively, which are different from each other. In the following, the image forming portion 11Y is described, and redundant explanation about other image forming portions 11M, 11C and 11K will be omitted.

The image forming portion 11Y includes, at a periphery of the photosensitive drum 1*y*, a charging roller 2*y*, an exposure device 3*y*, the developing device 4*y*, a transfer roller 6*y* and drum cleaning device 7*y*. The photosensitive drum 1*y* is prepared by forming a photosensitive layer of an OPC photosensitive material on an outer peripheral surface of an aluminum cylinder. The photosensitive drum 1*y* is rotated in an arrow R direction at a predetermined process speed.

The charging roller 2*y* electrically charges a surface of the photosensitive drum 1*y* to a negative potential uniformly by being supplied with an oscillating voltage in the form of a negative DC voltage biased with an AC voltage. The exposure device 3*y* which is an example of an exposure portion exposes the photosensitive drum 1*y* which is an example of a photosensitive member, so that an electrostatic image is formed. The exposure device 3*y* scans the surface of the photosensitive drum 1*y* with a laser beam, obtained by ON-OFF modulation of a scanning line image signal developed from the yellow image on an associated scanning line, through a rotating mirror, so that the electrostatic image is written (formed) on the surface of the photosensitive drum 1*y*. During image formation, the exposure device 3*y* effects the scanning line exposure while turning the laser beam on and off at 1200 dpi, so that the exposure device 3*y* writes (forms) the electrostatic image for an image on the photosensitive drum 1*y*.

The developing device 4*y* which is an example of a developing portion develops the electrostatic image into a toner image by using a developer containing a toner and a carrier. The developing device 4*y* circulates the developer (two-component developer) containing the toner (non-magnetic) and the carrier (magnetic) while stirring the developer, and charges the toner to a negative polarity and charges the carrier to a positive polarity. The developing device 4*y* carries the charged developer on a developing sleeve in an erected chain state, and the peripheral surface of the photosensitive drum 1*y* is rubbed with the charged developer. By applying an oscillating voltage, in the form of a negative DC voltage biased with an AC voltage, to the developing sleeve, the toner in the developer is moved on the photosensitive drum 1*y*, so that the electrostatic image is developed into the toner image.

The transfer roller 6*y* forms a transfer portion for the toner image between the photosensitive drum 1*y* and the intermediary transfer belt 51. By applying a positive DC voltage to the transfer roller 6*y*, the negative toner image carried on the photosensitive drum 1*y* is transferred onto the intermediary transfer belt 51. To the transfer roller 6*y*, a voltage of +900 V was applied. The intermediary transfer belt 51 is extended around and supported by a tension roller 93, an inner secondary transfer roller 71, and a driving roller 92, and is driven by the driving roller 92 to be rotated in an arrow R2 direction.

The intermediary transfer belt 51 is an endless belt of a polyimide resin material in which carbon black particles are dispersed to impart electroconductivity to the intermediary transfer belt 51. A tension spring 931 urges the tension roller 93 outwardly, and thus applies tension to the intermediary transfer belt 51.

An outer secondary transfer roller 72 contacts the intermediary transfer belt 51 supported by the inner secondary transfer roller 71 to form the secondary transfer portion T2. By applying a positive DC voltage to the outer secondary transfer roller 72, the toner image on the intermediary transfer belt 51 is transferred onto the sheet P.

The drum cleaning device 7*y* collects a transfer residual toner deposited on the photosensitive drum 1*y* by rubbing the photosensitive drum 1*y* with a cleaning blade.

A belt cleaning device 101 collects a transfer residual toner deposited on the surface of the intermediary transfer belt 51 by rubbing the intermediary transfer belt 51 with a cleaning blade.

As shown in FIG. 2, the reader portion 200 is controlled by the reader controller 403. The printer controller 401 holds a look-up table for image formation (GLUT) in RAM 412. A power source for the RAM 412 is backed up by a storage battery, and therefore even when a main power source of the image forming apparatus 100 is turned off, data such as the look-up table GLUT in the RAM 412 is maintained.

On the basis of information of the look-up table GLUT held in the RAM 412, the printer controller 401 applies a dither pattern to the density gradation of the image data inputted into the reader image processor 402. The printer controller 401 converts the image density of the inputted data into the dither pattern for the electrostatic image by using the look-up table GLUT. The printer controller 401 sets the dither pattern and a resolution which depend on attributes (image, text and the like) of the image.

As shown in FIG. 3, an image processor (processing portion) 435 subjects the RGB density data as the inputted image signal to conversion so that the RGB density data provides a mixing amount of respective color components of yellow Y, magenta M, cyan C and black K. The printer controller 401 executes image formation by using image data having density gradation of 256 levels having 8-bit resolution for each color component. For each color, a maximum density of 256/256 is described as "FF" in hexadecimal digit, and a minimum density of 0/256 is described as "00" in hexadecimal digit. An output γ-correcting portion 432 is provided with the look-up table GLUT for impacting a desired gradation property to an outputted image at each of the image forming portions 11Y, 11M, 11C and 11K.

A dither processor 433 carries out dithering for a (gray-scaled) half-toner image. The dither processor 433 includes a plurality of unshown dithering circuits, and changes the resolution depending on an image signal attribute (image, text or the like). A laser dither 434 controls light emission of a semiconductor laser element of the exposure device 3*y* by using the image signal obtained by developing the dither pattern on the scanning line. The laser driver 434 controls an amount of the light emission of the semiconductor laser element.

(Developer Supply Control)

Figure 4:
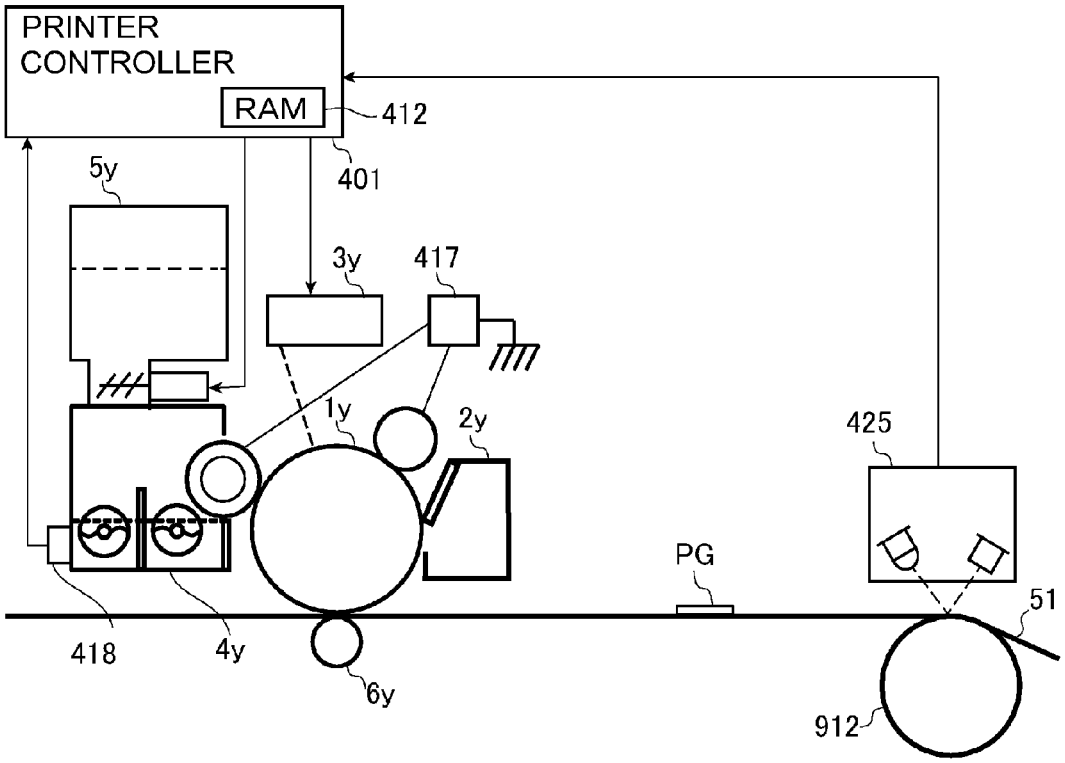
FIG. 4 is an illustration of developer supply control.

FIG. 4 is an illustration of developer supply control. As shown in FIG. 4, a developer supply portion 5*y* which is an example of a supply portion supplies the developer (toner) to the developing device 4*y* which is an example of a developing portion. The printer controller 401 also functioning as a supply controller detects a supply control toner image (patch image), formed by an exposure amount for supply control, by an optical sensor 425, and then controls an amount of the toner, to be supplied by the developer supply portion 5*y*, on the basis of a signal value of the detected control toner image.

The developer supply portion 5*y* supplies a supply developer of 100% in toner to the developing device 4*y*. A T/D ratio is a ratio of the toner weight to a total weight of the carrier and the toner of the two-component developer. A toner charge amount Q/M is a charge quantity of electricity per unit weight of the toner. The T/D ratio and the toner charge amount Q/M are very important parameters for stabilizing a density of the outputted image of the image forming apparatus 10. In the image forming apparatus 10, when the toner is consumed with the development of the electrostatic image on the photosensitive drum 1*y*, the toner charge amount Q/M increases while the T/D ratio of the two-component developer in the developing device 4*y* lowers, so that the density of the outputted image lowers.

For this reason, the printer controller 401 obtains the amount of the toner, every image formation of one sheet on the basis of the image data, consumed with the image formation. The developer supply portion 5*y* is actuated at timing when subsequent image formation is carried out, so that the toner in an amount corresponding to the consumed toner amount is supplied to the developing device 4*y*.

However, there is an error in amount of the toner consumed with the image formation, and therefore when the error is accumulated, there is a possibility that the T/D ratio of the developer in the developing device 4*y* changes. Therefore, the developing device 4*y* is provided with an inductance sensor 418. The inductance sensor 418 generates an output depending on a magnetic permeability of the developer circulated in the developing device 4*y*. The magnetic permeability of the developer increases when the T/D ratio lowers, and decreases when the T/D ratio increases.

The printer controller 401 measures the T/D ratio of the developer on the basis of an output of the inductance sensor 418, and adjusts the amount of the toner to be supplied from the developer supply portion 5*y* to the developing device 4*y* every image formation so that the T/D ratio converges to a predetermined target value. By making correction of the supply toner amount depending on the output of the induction sensor 418, the T/D ratio of the developer in the developing device 4*y* is changed to a predetermined target value.

That is, the printer controller 401 continuously measures the magnetic permeability of the developer in the developing device 4*y* by using the inductance sensor 418, and compares the magnetic inductance with a target value corresponding to a desired T/D ratio. When the magnetic permeability of the developer is away from the target value and lowers, the supply toner amount from the developer supply portion 5*y* is decreased. On the other hand, when the magnetic permeability of the developer is away from the target value and increases, the supply toner amount from the developer supply portion 5*y* is increased.

However, even at a constant T/D ratio, when the toner charge amount changes, the toner amount used for developing the same electrostatic image formed on the same photosensitive drum 1*y* changes. When the image formation with a small toner use amount continues, the toner charge amount increases and thus the toner amount per unit area becomes small, and therefore the density of the outputted image lowers. When the image formation with a large toner use amount continues, the toner charge amount lowers and thus the toner amount per unit area increases, and therefore the density of the outputted image increases.

Therefore, in the image forming apparatus 100, the supply control toner image is formed every image formation of a predetermined number of sheets, and then the supply control toner image (patch image) is detected by the optical sensor 425. A signal detected by the optical sensor 425 correlates with the toner amount per unit area of the toner image as described later. Accordingly, from the signal detected by the optical sensor 425, a change in the toner amount per unit area of the patch image is grasped. The printer controller 401 controls the toner supply amount by the developer supply portion 5*y* depending on such a change in toner amount per unit area of the patch image. Such control is called the ATR (Automatic Toner Replenishment) patch control.

Such ATR patch control will be described specifically. For example, in the case where the image is continuously formed in an A4-long edge feeding manner, every image formation of 100 sheets, the printer controller 401 automatically enlarges an image interval and forms the patch image on the photosensitive drum 1*y*. The patch image formed on the photosensitive drum 1*y* is transferred onto the intermediary transfer belt 51 and then fed to the sensor 425. The optical sensor 425 detects the patch image on the intermediary transfer belt 51 and generates an output (signal value) depending on the toner amount per unit area.

The optical sensor 425 is provided opposed to the intermediary transfer belt 51 at a position downstream of the plurality of photosensitive drums with respect to a rotational direction of the intermediary transfer belt 51. The optical sensor 425 irradiates the intermediary transfer belt 51 with infrared light emitted from a light-emitting portion (LED) and detects reflected light at a light-receiving portion (photo-diode). At this time, with a larger toner amount per unit area of the toner image, a proportion of scattering of the toner on the surface of the intermediary transfer belt 51 increases, and therefore an amount of the reflected light entering the optical sensor 425 decreases, so that an output of the sensor 425 lowers. Accordingly, from the output (signal value) of the optical sensor 425, the toner amount per unit area of the toner image can be grasped.

The printer controller 401 corrects the above-described target value depending on the signal value of the optical sensor 425, and thus changes the T/D ratio in the developing device 4*y*. That is, in the case where the toner amount per unit area of the supply control toner image is less than the target value, the printer controller 401 discriminates that the toner charge amount is higher than a normal value, and then decreases the target value. As a result, the toner supply amount increases, so that the T/D ratio in the developer becomes high. When the T/D becomes high, the toner charge amount of the developer in the developing device 4*y* lowers.

On the other hand, in the case where the toner amount per unit area of the supply control toner image is more than the target value, the printer controller 401 discriminates that the toner charge amount is lower than the normal value, and then increases the target value. As a result, the toner supply amount decreases, so that the T/D ratio becomes low. When the T/D ratio becomes low, the toner charge amount of the developer in the developing device 4*y* increases. In this way, on the basis of the signal by which the patch image is detected using the optical sensor 425, the amount of the toner supplied by the developer supply portion 5*y* is controlled, so that the T/D ratio in the developing device 4*y* is changed and thus a desired developing property can be obtained.

(Exposure Condition of Patch Image)

Next, an exposure condition of the patch image used in the ATR patch control as described above will be described. The laser beam output of the exposure device 3*y* is settable at 512 levels with resolving power of 9 bit. The laser beam output (exposure amount for the supply control) when the electrostatic image for the patch image is formed in a brand-new state (initial state) such as during new set-up of the image forming apparatus 10 is set at 256 which is just a center value of 512. The printer controller 401 forms the patch image by such a laser beam output of 256/512, and the toner amount per unit area detected by the optical sensor 425 is stored as the target value in the RAM 412 as a storing portion. Thereafter, the patch image is formed at a predetermined interval, and then the toner amount per unit area is detected by the optical sensor 425. Then, a deviation between the detected toner amount per unit area and the target value is detected, and then the target value of the inductance sensor 418 is continuously corrected so as to eliminate (cancel) the deviation.

The exposure device 3*y* has the resolution of 1200 dpi. The printer controller 401 controls the exposure device 3*y* in a 2 line-1 space pattern formed by alternating two-dot lines (exposure) and one-dot space (non-exposure), and thus writes (forms) the electrostatic image for the patch image. It is also possible to form the patch image for the half-tone image using the dither pattern used in normal image formation. However, it would be considered that in the dither pattern having a low toner converge used for the normal image formation, the influence of the scraping-off by the developing sleeve is large, and therefore the fluctuation in the case where cannot accurately reflect the fluctuation in toner amount per unit area of the patch image. For this reason, in this embodiment, the patch image is formed in the 2 line-1 space pattern as described above using a slid image having a high toner coverage.

Further, in the case where the electrostatic image for the supply control toner image is formed, the exposure device 3*y* may also use the laser beam output used during the image formation. However, in the case where the toner amount per unit area is measured by the optical sensor 425, measurement accuracy of the optical sensor 425 lowers in a region where the toner amount per unit area is large. For this reason, in the case where the electrostatic image for the supply control toner image is formed, in order to lower the developing contrast than that during the image formation, the laser beam output lower than that during the image formation is set for the exposure device 3*y*.

(Exposure Condition During Image Formation)

Figure 5:
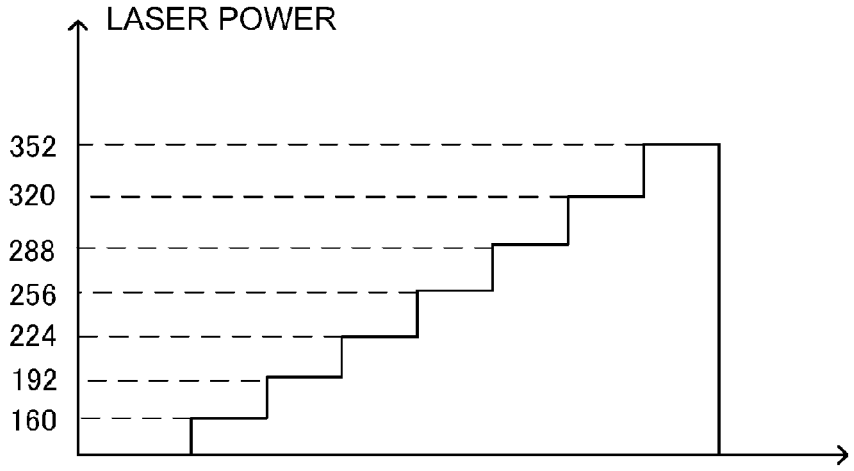
In FIG. 5, (a) and (b) are illustrations of a reference chart used for laser beam output setting by a fixed image.
Figure 5:
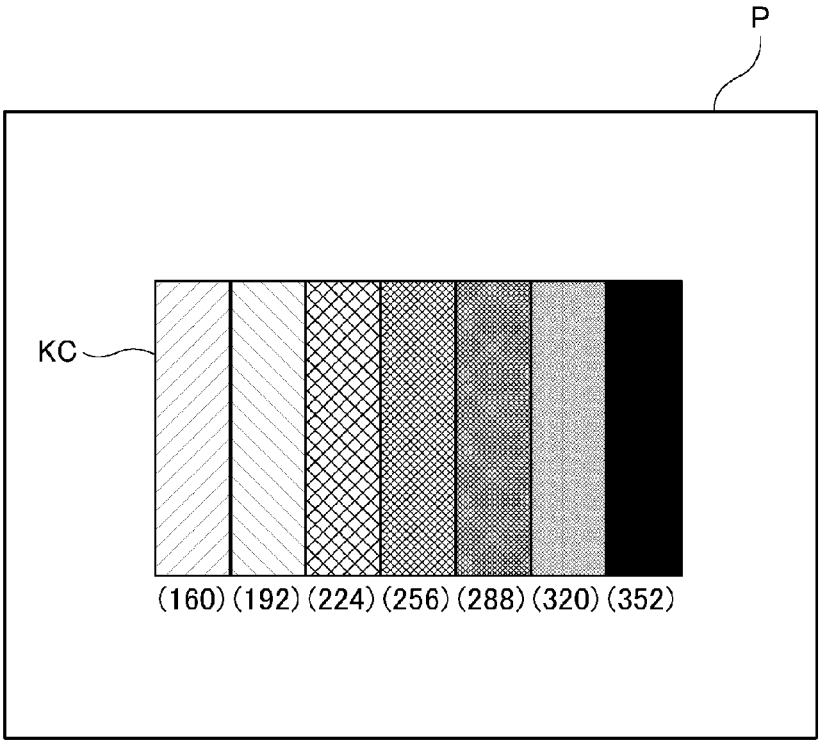
Figure 6:
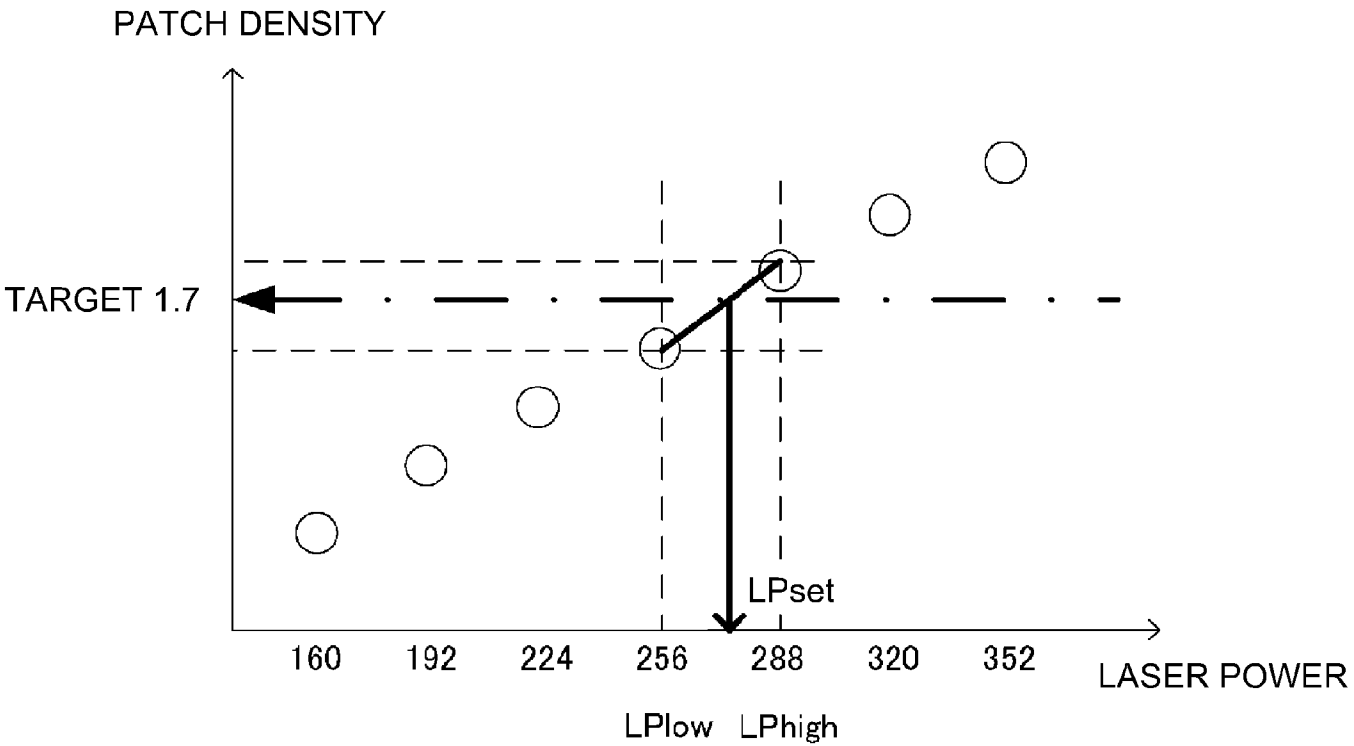
FIG. 6 is an illustration of the laser beam output setting by the fixed image.

Next, the exposure condition during the normal image formation will be described. In FIG. 5, (a) and (b) are illustrations of a reference chart used for laser beam output setting using the fixed image. FIG. 6 is an illustration of the laser beam output setting using the fixed image. In FIG. 5, (a) shows the laser beam output, and (b) is a plan view of the reference chart.

First, during the new set-up of the image forming apparatus 10, the target value of the patch image is set, and thereafter the setting of the laser beam output (exposure condition) during the image formation is made using the fixed image. In the laser beam output setting, the fixed image for exposure control toner image is outputted, and then is read by the reader portion 200. Then, the laser beam output of the exposure device 3*y* is adjusted so that the electrostatic image of a maximum density (100% exposure) provides a desired value of the reflection density of the fixed image obtained by developing the electrostatic image and then by fixing the detected image.

As shown in (a) of FIG. 5, the laser beam output of the exposure device 3*y* is settable at 512 levels with the resolving power of 9 bit. The printer controller 401 changes the laser beam output at 7 levels of 160/512, 192/512, 224/512, 256/512, 288/512, 320/512 and 352/512 in the image on one sheet. At this time, the surface of the photosensitive drum 1*y* is charged to a dark-portion potential VD=−700 V, and a DC voltage Vdc applied to the developing sleeve is set at −600 V.

As shown in (b) of FIG. 5, in the laser beam output setting using the fixed image, the fixed image of a reference chart KC for reflection density measurement is formed on an A3-sized sheet. On the A3-sized sheet discharged from the image forming apparatus 10, corresponding to the above-described laser beam output at the 7 levels, the fixed images having 7 density levels are arranged adjacently to each other.

A service person or a user places the sheet, on which the fixed images having 7 density levels are formed, on the original supporting plate 202 of the reader portion 20, and then inputs a predetermined instruction (command). In response to the inputted instruction, the reader portion 200 measures the reflection density of the fixed images having the 7 density levels, and then sends the measured values to the printer controller 401.

As shown in FIG. 6, the printer controller 401 obtains the laser beam output, providing the target density of 1.7 for the fixed image, on the basis of data of 7 sets each of the reflection density of the fixed image and the laser beam output, and then sets the laser beam output for the exposure device 3*y*. For example, by making proportional interpolation between the value of 256 immediately before the laser beam output providing the fixed image target density of 1.7 and the value of 288 immediately after the laser beam output providing the fixed image target density of 1.7, the laser beam output of the exposure device 3*y* during the normal image formation is set at 275.

(Dither Pattern Setting of Half-Tone Image)

Figure 7:
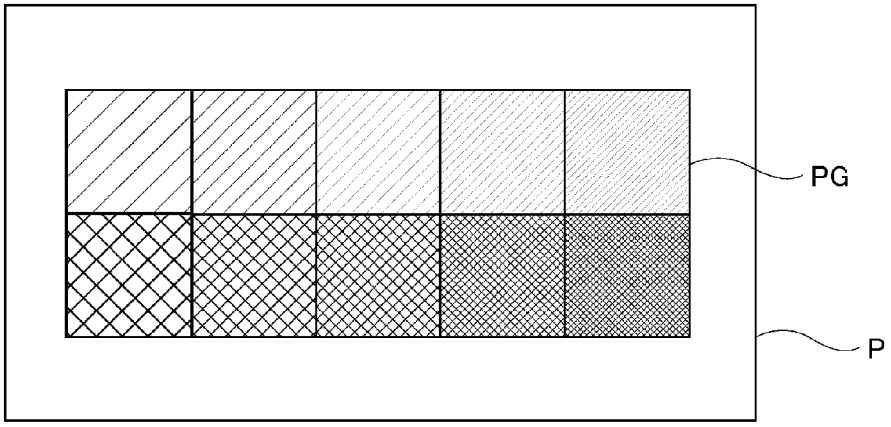
FIG. 7 is an illustration of a pattern image used for (toner) gradation setting by the fixed image.

Setting of the dither pattern to be outputted when gradation correction for setting the density of the half-tone image is made will be described. FIG. 7 is an illustration of a pattern image used for the gradation setting using the fixed image.

After the "Laser beam output setting during image formation" is made as described above, the setting of the dither pattern using the fixed image is carried out. In the dither pattern setting using the fixed image, in the fixed image obtained by exposing the electrostatic image to light at the laser beam output set by using the fixed image, the dither pattern is assigned for each of gradation levels of the density gradation of the inputted image so that each of the gradation levels of the half-tone image provides a desired reflection density. The dither pattern setting using the fixed image is stored as a look-up table Pascal LUT for initial setting.

As shown in FIG. 7, the fixed images of the pattern image PG for measuring the reflection density are formed on the A3-sized sheet. In this case, under an image forming condition (dark-portion potential, developing potential, laser beam output) set in the "Laser beam output setting during image formation", the fixed images of the pattern image PG of 10 levels in dither pattern are formed on the A3-sized sheet. For each of the colors of Y, M, C and K, the signal value of the dither pattern of 100% in exposure rate is taken as 512, and the fixed images having 10 exposure rate levels of 50, 100, 150, 200, 250, 300, 350, 400, 450 and 512 are formed. The dither pattern for each color is dispersed using a dot screen (chain dot) of 170 lpi in line number in which screen angles are made different from each other. In the case of an example of the black, the screen angle is 45°.

The service person or the user places the sheet, on which the pattern images PG having 10 dither pattern levels are formed, on the original supporting plate 202 of the reader portion 20, and then inputs a predetermined instruction (command). In response to the inputted instruction, the reader portion 200 measures the reflection density of the each of dither pattern portions of the pattern images having the 10 density levels, and then sends the measured values to the printer controller 401.

The printer controller 401 calculates, on the basis of the measured values of reflection density of the pattern images PG having the 10 dither pattern levels, the look-up table Pascal LUT so that the density gradation of the fixed image coincides with a predetermined gradation target value. The look-up table Pascal LUT is a conversion table for assigning the dither patterns different in density to associated gradation levels (FF to 00) for each of the colors, and is stored in the RAM 412 of the printer portion 100 shown in FIG. 2. During the image formation, a look-up table GLUT formed by multiplying the look-up table GLUT by a look-up table PreGLUT is used. On the basis of information of the look-up table GLUT, the dither pattern is assigned to the density data of the image data inputted into the image processor 405.

(Multiple-Gradation Patch Control)

Figure 8:
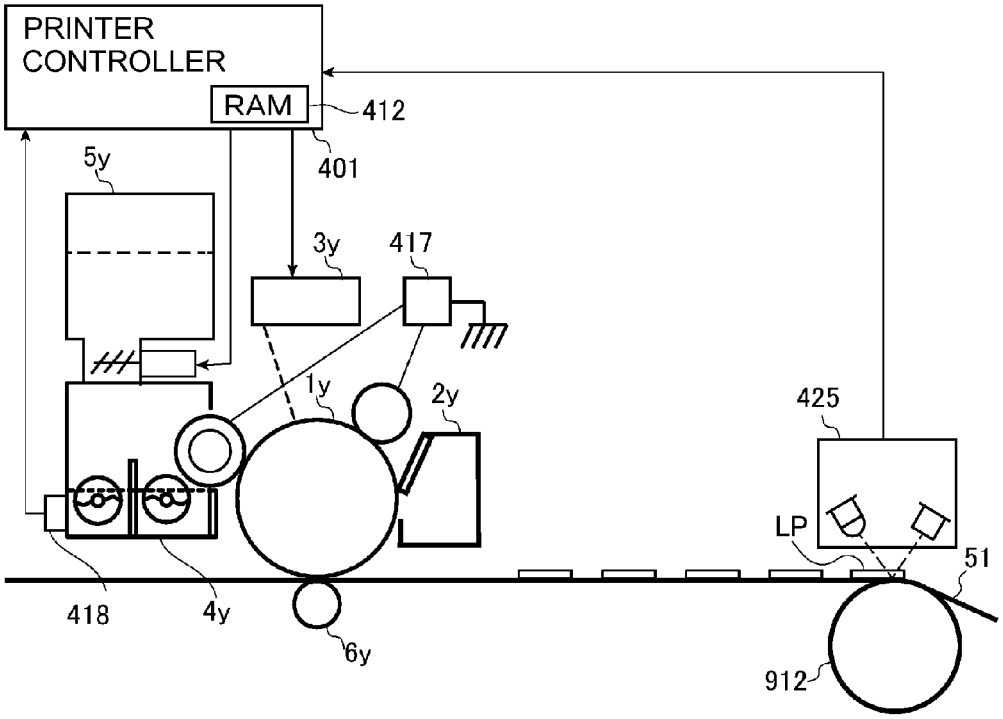
FIG. 8 is an illustration of multiple-(tone) gradation patch control.
Figure 9:
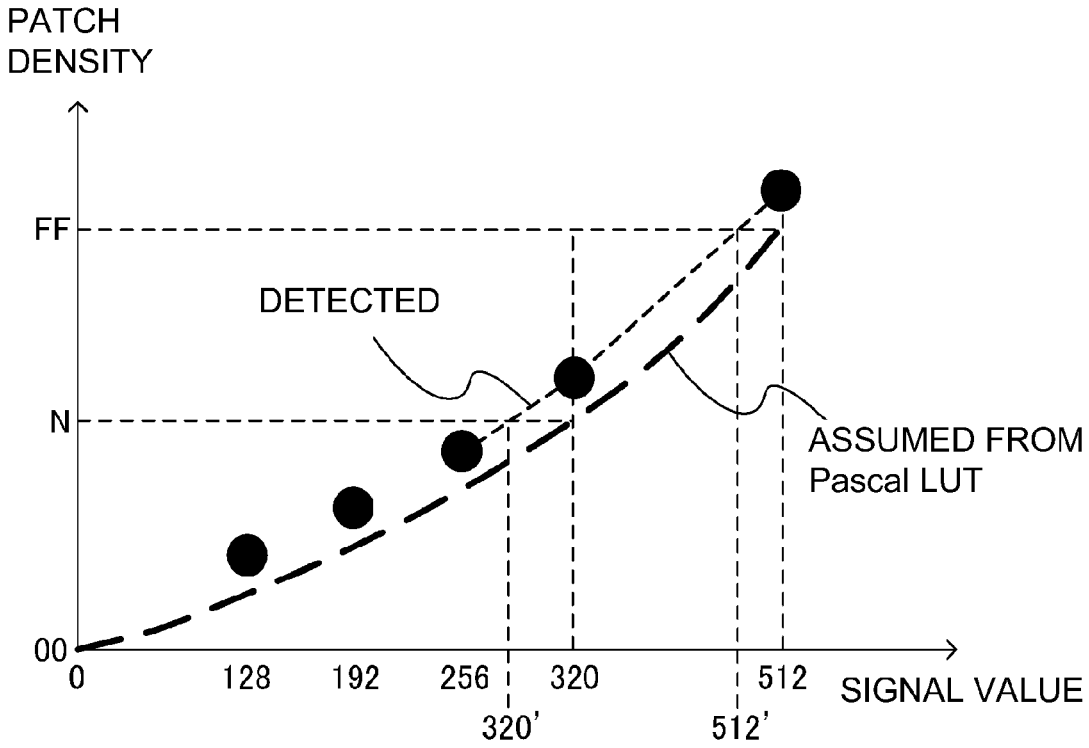
FIG. 9 is a graph for illustrating a correcting process of γ-characteristic curve for exposure.

Next, the multiple-gradation patch control for performing the density correction during the image forming operation will be described. FIG. 8 is an illustration of the multiple-gradation patch control. FIG. 9 is an illustration of obtained data by the multiple-gradation patch control. The look-up table Pascal LUT is obtained by performing the laser beam output setting during the image formation at the time of the new set-up, and thereafter at the image forming portion 11Y, toner image forming power changes due to accumulation of image formation, change in temperature or humidity, and the like. For this reason, the printer controller 401 carries out the multiple-gradation patch control during the image forming operation, and thus corrects the half-tone density, for the image on the basis of the look-up table GLUT, to a proper density.

In the multiple-gradation patch control, during the image forming operation, control toner images for dither patterns of a plurality of predetermined species are formed on the intermediary transfer belt 51, and then detects the toner amounts per unit area by the optical sensor 425. Then, on the basis of detected information of the dither patterns of the plurality of species, the look-up table GLUT used for image formation is corrected.

As shown in FIG. 9 with reference to FIG. 8, when the signal value of the dither pattern of 100% in exposure rate is 512, the printer controller 401 is capable of outputting the half-tone dither patterns different in density value at 512 levels. The printer controller 401 forms the control toner images in dither patterns of 5 levels in signal value corresponding to 512, 320, 256, 192 and 128 after obtaining the look-up table Pascal LUT using the fixed image as described above. The control toner images are multiple-gradation toner images having a plurality of density values (5 levels), and are transferred onto the intermediary transfer belt 51, and then the density values are detected by the optical sensor 425. The printer controller 401 converts the density values detected by the optical sensor 425 into density values, and thus obtains the density values of the control toner images having the 5 dither pattern levels, and then stores the density values in the RAM 412.

As shown in FIG. 9, the printer controller 401 compares the look-up table GLUT held during the last image formation with the density values of the control toner images having the dither patterns of 5 levels in signal value. In the case where there arises a deviation, by a predetermined level or more, from assumed density values from GLUT corresponding to the signal values of 5 levels, the look-up table GLUT used for image formation is corrected by changing PreGLUT. Thereafter, every image formation of 30 sheets, the control toner images of 5 levels in dither pattern are formed, and then the correction of the look-up table GLUT is similarly repeated.

(Photosensitive Drum Exchange)

As shown in FIG. 1, each of the photosensitive drums 1*y*, 1*m*, 1*c* and 1*k* and each of the developing devices 4*y*, 4*m*, 4*c* and 4*k* are constituted as separate voltages each capable of being individually exchanged. The image forming portion 11Y is constituted by integrally assembling the charging roller 2*y*, the drum cleaning device 7*y* and the photosensitive drum 1*y* into a drum cartridge. The developing device 4*y* is separable from the drum cartridge. Accordingly, each of the drum cartridge and the developing device 4*y* can be individually exchanged (replaced) with a new one.

In the image forming apparatus 10, the photosensitive drum 1*y* and the developing device 4*y* are not exchanged simultaneously with each other, but the member or device which is not required to be exchanged is continuously used. Even when the exchange of the photosensitive drum 1*y* is needed, in the case where the developing device 4*y* is not exchanged, there is a possibility that a lowering in accuracy of the developer supply control (ATR patch control) using the patch image generates.

A shift amount of the surface potential of the photosensitive drum 1*y* relative to the exposure amount is referred to as drum sensitivity. In the case where the photosensitive drum 1*y* is exchanged, there is a case where the drum sensitivity is different between the photosensitive drum 1*y* used until now and the exchanged new photosensitive drum 1*y*. For this reason, in the case where the same laser beam output as that before the exchange is used, although the developing characteristic of the developing device 4*y* is not changed, due to a variation in drum sensitivity between the photosensitive drums before and after the exchange, the toner amount per unit area of the patch image varies.

Then, when the toner is supplied after the exchange to the developing device 4*y* using the same target value to that before the exchange, the toner density of the developer in the developing device 4*y* after the exchange is adjusted to a value different from the value before the exchange. As a result, the density of an outputted product deviates from a desired density, and it becomes difficult in some cases to correct the developer state to a desired state by carrying out optimum control of the T/D ratio of the developer.

Therefore, in this embodiment, in the case where the photosensitive drum 1*y* is exchanged, the printer controller 401 as an adjusting portion adjusts the laser beam output (exposure amount for supply control) when the patch image is formed.

(Case where Both of Photosensitive Drum and Developing Device are Exchanged)

First, the case where both of the photosensitive drum and the developing device are exchanged will be described. An operator such as the service person or the user resets, when the drum cartridge and the developing device 4*y* are exchanged, both of a sheet number counter for the photosensitive drum 1*y* and a sheet number counter for the developing device 4*y* which are stored in the RAM 412. When the sheet number counter for the photosensitive drum 1*y* is reset, the printer controller 401 discriminates that the photosensitive drum 1*y* has been exchanged. When the sheet number counter for the developing device 4*y* is reset, the printer controller 401 discriminates that the developing device 4*y* has been exchanged. Accordingly, the printer controller 401 corresponds to an exchange detecting portion and a developer detecting portion.

In Embodiment 1, in the case where both of the photosensitive drum 1*y* and the developing device 4*y* are exchanged, similarly as during the above-described new set-up, the laser beam output when the patch image is formed is set at a fixed value of 256. That is, in the case where both of the photosensitive drum 1*y* and the developing device 4*y* are exchanged, the printer controller 401 does not adjust the laser beam output irrespective of the detection of the exchange of the photosensitive drum by the exchange detecting portion. Then, the electrostatic image is subjected to the above-described 2 line-1 space exposure and the fixed value of 256 and then is developed with the developer having a reference toner density in the developing device 4*y*, so that the toner amount per unit area read by the optical sensor 425 is stored as a new target value.

(Case where Photosensitive Drum is Exchanged)

Next, the case where the photosensitive drum is exchanged with no exchange of the developing device will be described. When the sheet number counter for the photosensitive drum 1*y* reaches a predetermined sheet number (e.g., 1,500,000 sheets), exchange requirement of the photosensitive drum 1*y* is displayed on the operating panel 426. In response to the display, the operator such as the service person or the user exchanges the photosensitive drum 1*y*. When the drum cartridge is exchanged, the operator opens a service screen on the operating panel 426, and then resets the value of the sheet number counter, for the photosensitive drum 1*y*, stored in the RAM 412. When the value of the sheet number counter, for the photosensitive drum 1*y*, stored in the RAM 412 is reset, the printer controller 401 discriminates that the photosensitive drum 1*y* has been exchanged. Accordingly, the printer controller 401 corresponds to the exchange detecting portion.

Figure 10:
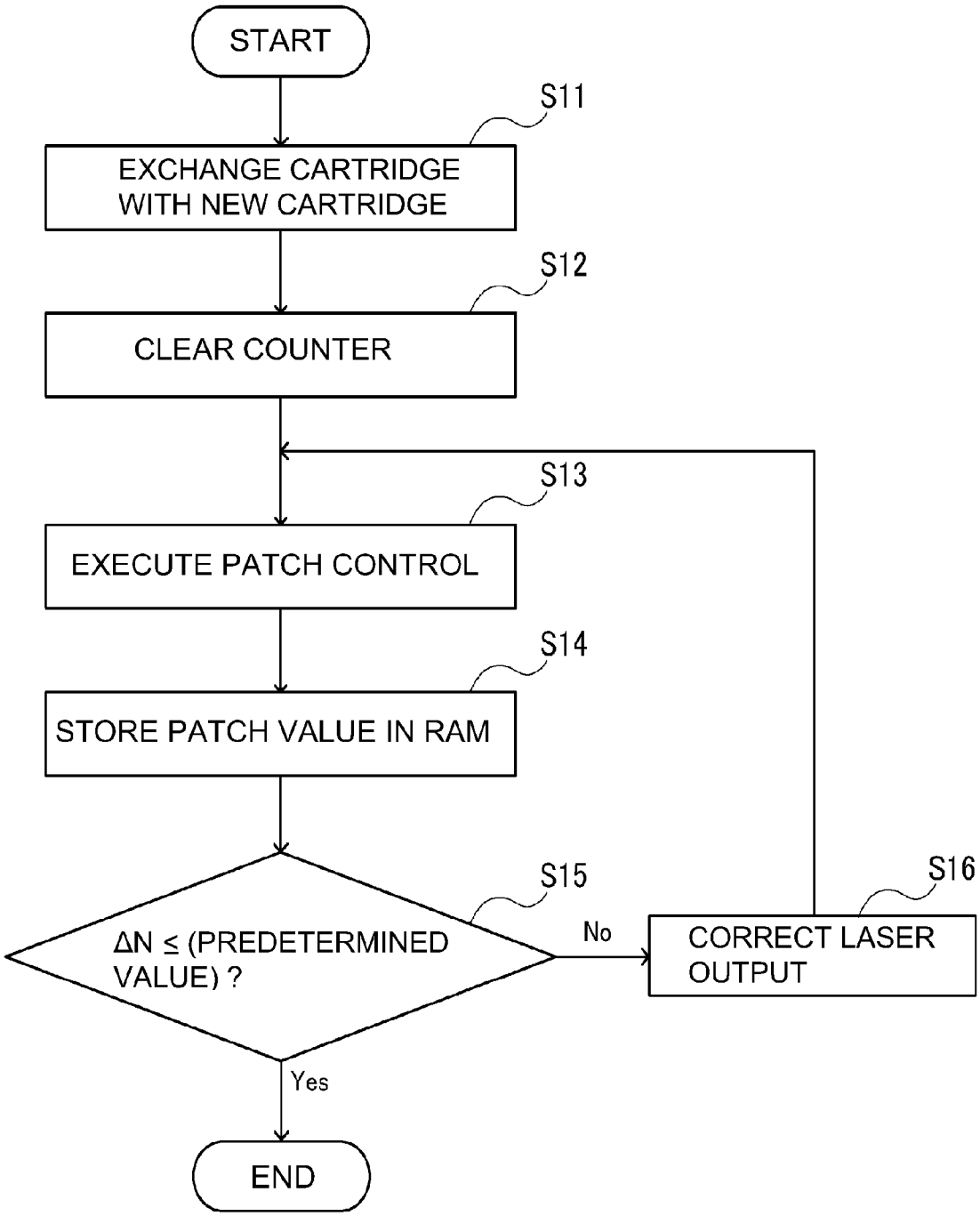
FIG. 10 is a flowchart of control in Embodiment 1.
Figure 11:
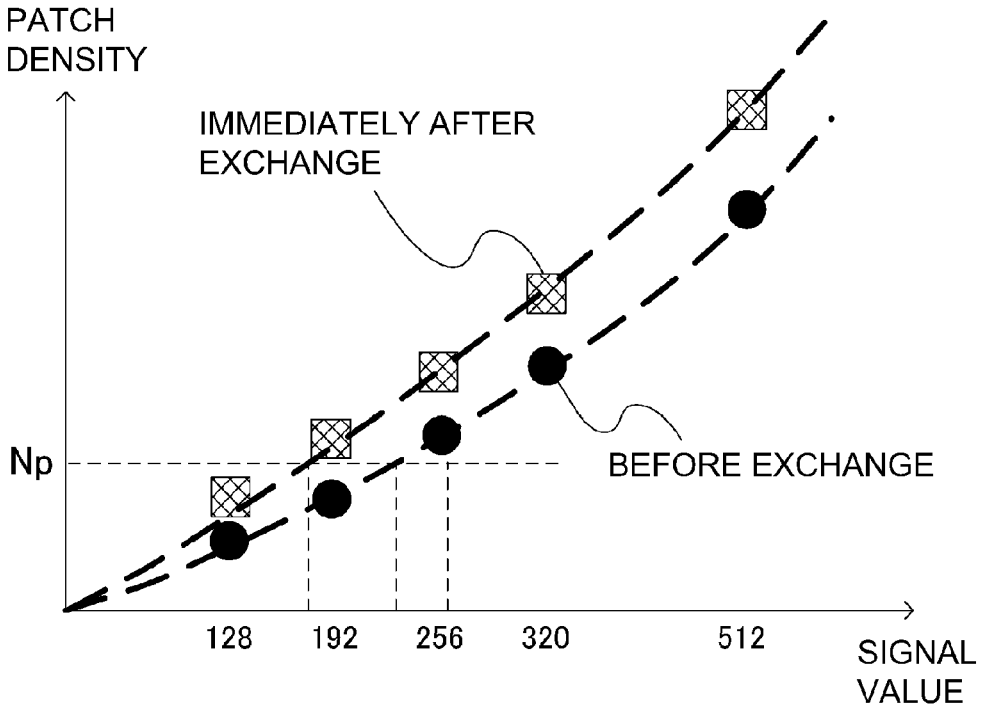
FIG. 11 is a graph for illustrating the laser beam output setting by the multiple-gradation patch control.

FIG. 10 is a flowchart of control in Embodiment 1. FIG. 11 is an illustration of laser beam output setting by the multiple-gradation patch control.

Before the exchange of the photosensitive drum 1*y*, when the printer controller 401 effects the multiple-gradation patch control, the printer controller 401 stores, in the RAM 412, the toner amount per unit area (density value) of each of the control toner images of 5 levels in dither pattern detected by the optical sensor 425. Further, the printer controller 401 stores, in the RAM 412, the toner amount per unit area (density value) of the patch image every formation of the patch image (supply control toner image) for effecting the developer supply control. The printer controller 401 updates (renews) the signal values (density information) of the 5 dither pattern levels, the data of the density values of the control toner images and the data of the density values of the patch images which are stored in the RAM 412. A power source for the RAM 412 is backed up, and therefore even when the power source is turned off, the data stored in the RAM 412 is not broken even when the photosensitive drum 1*y* is exchanged.

As shown in FIG. 10, when the drum cartridge is exchanged (replaced) with a new one while leaving the developing device 4*y* (S11) and then the sheet number counter for the photosensitive drum 1*y* is reset (S12), the printer controller 401 executes the multiple-gradation patch control which is an operation in a mode (S13). In the multiple-gradation patch control, the control toner image LP, of 5 levels in dither pattern consisting of 512, 320, 256, 192 and 128, which is an example of the control toner image formed in the operation in the mode is formed, and then is detected by the sensor 425 (S13). The printer controller 401 stores, in the RAM 412, the signal value (corresponding to the toner amount per unit area (signal value) detected by the optical sensor 425 (S14). Accordingly, a first signal value obtained by detecting the control toner image LP, formed in the dither pattern using the photosensitive drum 1*y* before the exchange, by the optical sensor 425 is stored in the RAM 412.

The printer controller 401 obtains the density value of the control toner image LP from the first signal value stored in the RAM 412 by making reference to GLUT. Further, the printer controller 401 obtains the density value of the control toner image LP from a second signal value obtained by detecting the control toner image LP, formed in the dither pattern using the photosensitive drum 1*y* after the exchange, by the optical sensor 425 by making reference to GLUT. Then, a difference value ΔN between these density values is obtained (S15). When the difference value ΔN is a predetermined value or more (No of S15), the printer controller 401 adjusts the laser beam output of the exposure device 3*y* as described later (S16), and then executes the multiple-gradation patch control again (S13). When the difference value ΔN is less than the predetermined value (Yes of S15), the printer controller 401 ends the control without changing the laser beam output.

A specific example of the case of "No" of S15 is shown in FIG. 11. As shown in the figure, compared with the case before the exchange of the photosensitive drum 1*y*, the density values of the control toner images LP of 5 levels in dither pattern after the exchange of the photosensitive drum 1*y* was shifted in an increasing direction. Further, the dither pattern gradation level corresponding to a density value (predetermined value) Np of the patch image formed in an initial stage of the photosensitive drum before the exchange and the developing device was 220 before the exchange of the photosensitive drum 1*y* and was 172 after the exchange of the photosensitive drum 1*y*. The laser beam output (exposure amount for supply control) for forming the control toner image LP after the exchange is adjusted on the basis of a relationship between gradation levels corresponding to the associated predetermined values in density value before and after the exchange described above. At this time, a half-tone density is increased by the exchange of the photosensitive drum 1*y*, and therefore the laser beam output after the exchange is lowered from the laser beam output before the exchange.

Specifically, the laser beam output (156) of the patch image before the exchange is multiplied by the above-described ratio (172/220) between the gradation levels, so that the laser beam output (256×172/220 nearly equal to 200) of the patch image after the exchange is obtained. Accordingly, in an example of FIG. 11, before and after the exchange, the laser beam output is lowered from 256 to 200. As a result, even when the ATR patch control is effected by using the target value before the exchange as it is, the toner density (concentration) of the developer is controlled at the substantially same voltage as that before the exchange.

(Effect of Embodiment 1)

In the case of Embodiment 1, on the basis of the signal vales (density information), by the optical sensor 425, of the control toner images before and after the exchange of the photosensitive drum 1*y*, the laser beam output (exposure amount for supply control) for forming the patch image after the exchange is adjusted. For this reason, the drum sensitivity relative to the exposure amount of the photosensitive drum after the exchange can be reflected in the laser beam output after the exchange, and even in the case where the photosensitive drum 1*y* is exchanged without exchanging the developing device 4*y*, it is possible to suppress the lowering in accuracy of the ATR patch control.

Further, in Embodiment 1, there is no need to exchange the developing device 4*y* when the photosensitive drum 1*y* is exchanged, and therefore consumables such as the developing device 4*y* can be continuously used effectively. For this reason, further extension of the lifetime of the consumables is realized, there are user advantages such as cost reduction of exchange ports and avoidance of long-time stop of the main assembly due to the exchange of the parts. There is also an advantage such as reduction is cost for the service person to go into action for maintenance.

In Embodiment 1, the setting of the laser beam output of the exposure device 3*y* is made by utilizing the data used in the already-existing multiple-gradation patch control, and therefore a mechanism and control which are added for realizing the control may only be less required. An operation procedure for ensuring reproducibility of the toner content before and after the exchange of the photosensitive drum 1*y* is not complicated, so that the operator can easily execute the operation. For this reason, a downtime of the image forming apparatus with the exchange of the photosensitive drum 1*y* is reduced, so that substantial productivity of the image forming apparatus is enhanced.

<Embodiment 2>

In Embodiment 2, when the exchange of the photosensitive drum is made, the multiple-gradation patch control is forcedly effected even when the timing thereof is not original timing, so that data of the toner amount per unit area of the control toner image is obtained. As shown in FIG. 8, the printer controller 401 is capable of executing an operation in a pre-measuring mode before the exchange of the photosensitive drum 1*y*. In the operation in the pre-measuring mode, only one dither pattern control toner image by which a toner amount per unit area close to the toner amount per unit area of the control toner image can be obtained is formed. The formed control toner image is detected by the optical sensor 425, and then is stored as a first signal value in the RAM 412.

Thereafter, similarly as in Embodiment 1, the operator exchanges the photosensitive drum 1*y*. Then, when the operator executes a predetermined instruction operation after the exchange, only one control toner image is formed under an exposure condition similar to that for the dither pattern used in the operation in the pre-measuring mode. The formed control toner image is detected by the optical sensor 425, and then is stored as a second signal value in the RAM 412. The printer controller 401 adjusts the laser beam output during the formation of the patch image so that the first signal value before the exchange and the second signal value after the exchange coincide with each other, by using the first and second signal values.

<Embodiment 3>

The control toner image used when the laser beam output (exposure output) during the supply control toner image formation is adjusted may also be the supply control toner image as it is. As shown in FIG. 4, in Embodiment 3, first information obtained by the printer controller 401 (information obtaining portion) before the exchange of the photosensitive drum 1*y* is stored in the RAM 412.

When the printer controller 401 (exchange detecting portion) detects the exchange of the photosensitive drum 1*y*, the printer controller 401 (adjusting portion) forms the patch image (supply control toner image) under the same condition as that before the exchange and then detects the patch image by the optical sensor 425, so that the printer controller 401 obtains second information.

Then, the printer controller 401 adjusts the laser beam output during the supply control toner image formation on the basis of the first information stored in the RAM 412 and the second information obtained after the exchange. Specifically, the printer controller 401 adjusts the laser beam output during the supply control toner image formation so that the toner amount per unit area of the supply control toner images before and after the exchange are equal to each other.

<Other Embodiments>

As mentioned above, the present invention was described based on the specific embodiments, but the present invention is not limited to the above-described embodiments. The present invention can also be carried out in other embodiments so long as the exposure output during the supply control toner image formation is adjusted on the basis of the toner amount per unit area before the exchange and the toner amount per unit area after the exchange, with respect to the toner image formed under a predetermined exposure condition. For example, the ATR patch exposure condition after the exchange may also be corrected on the basis of a density difference obtained based on a detection result of ATR patches, by the optical sensor 425, formed under the same exposure condition before and after the exchange of the photosensitive member. Further, in order to effect the ATR control with accuracy even when the sensitivity of the photosensitive member changes with accumulation of the image formation, even in the case where a constitution in which the exposure condition of the supply control toner image is changed depending on the accumulation of the image formation is employed, the present invention is applicable thereto.

The exposure condition after the exchange may also be corrected on the basis of a density difference obtained based on a detection result of ATR patches, by the optical sensor 425, of the ATR patch before the exchange of the photosensitive member and the ATR patch formed under a preset exposure condition after the exchange of the photosensitive member.

Accordingly, the image forming apparatus is not limited to the digital exposure type in which a certain laser beam output is turned on and off to carry out the exposure, but may also be carried out also in an analog exposure type in which the laser beam output is changed to represent the half-tone image density. In this case, the control toner images may also be formed before and after the exchange of the photosensitive drum 1*y* by using the laser beam output having a predetermined signal value, of the half-tone gradation level, lower than a maximum signal value used for the image formation. Even in the digital exposure type, the control toner image formed by such an analog exposure type may also be utilized.

The image forming apparatus can be carried out irrespective of the types such as one-drum type/tandem type and intermediary transfer type/recording material feeding type. The image forming apparatus can be carried out irrespective of the number of image bearing members, the charging type of the image bearing members, an electrostatic image forming type, a transfer type, and the like. In the above-described embodiments, only a principal portion relating to toner image formation and transfer is described, but the present invention can be carried out in image forming apparatuses in various uses such as printers, various printing machines, copying machines, facsimile machines, and multi-function machines, by adding necessary equipment, devices and casing structures. The optical sensor 425 is not required to be disposed opposed to the intermediary transfer belt 51, but may also be disposed opposed to each of the photosensitive drums on a one-by-one basis.

In the case of the present invention, on the basis of the signal values, by the sensor, of the control toner images before and after the exchange of the photosensitive member, the supply control exposure amount for forming the supply control toner image after the exchange is adjusted. For this reason, the sensitivity relative to the exposure amount of the photosensitive member after the exchange can be reflected in the exposure amount for the supply control after the exchange, so that even in the case where the photosensitive member is exchanged without exchanging the developing portion, it is possible to suppress the lowering in accuracy of the ATR patch control.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 220921/2013 filed Oct. 24, 2013, which is hereby incorporated by reference.

What is claimed is:

1. An image forming apparatus comprising:

a photosensitive member;

an exposure portion configured to expose said photosensitive member to light to form an electrostatic image;

a developing portion configured to develop the electrostatic image on said photosensitive member with a developer containing a toner and a carrier;

wherein each of said photosensitive member and said developing portion is configured to be independently exchangeable, a sensor configured to detect a toner image formed by said developing portion to output density information depending on a toner amount per unit area;

a supply portion configured to supply the developer to said developing portion;

a controller configured to control a supplying operation of said supply portion on the basis of a detection result, detected by said sensor, of a supply control toner image formed by said exposure portion;

a storing portion configured to store the detection result detected by said sensor; and an exchange detecting portion configured to detect information for discriminating exchange of said photosensitive member, wherein said controller is configured to execute an operation in a mode, in which said controller adjusts an exposure condition for forming the supply control toner image by the exposure portion after exchange of said photosensitive member on the basis of first information and second information, and wherein the first information is stored in said storing portion and is a detection result when a first control toner image, formed before the exchange of the photosensitive member, is detected by said sensor, and the second information is a detection result when a second control toner image, formed after the exchange of said photosensitive member, is detected by said sensor.

2. An image forming apparatus according to claim 1, wherein the first control toner image and the second control toner image include multiple toner images having a plurality of density values.

3. An image forming apparatus according to claim 1, wherein said controller is configured to, when said developing portion is a new developing portion, execute an initial operation in which an initial control toner image formed under a predetermined initial exposure condition is detected by said sensor, and then the exposure condition for forming the supply control toner image is set at the predetermined initial exposure condition, wherein said controller is configured to control the supplying operation of said supply portion on the basis of a detection result of the initial control toner image detected by said sensor, and wherein said controller is configured to adjust the exposure condition for forming the supply control toner image after the exchange of said photosensitive member, on the basis of the detection result of the initial control toner image detected by said sensor.

4. An image forming apparatus according to claim 3, wherein an exposure amount for forming the supply control toner image by said exposure portion after the exchange of said photosensitive member is obtained by multiplying the exposure amount for forming the supply control toner image by said exposure portion before the exchange of said photosensitive member by a ratio, and wherein the ratio is a ratio of the exposure amount of said exposure portion set on the basis of the second control image and the initial control toner image to the exposure amount of said exposure portion set on the basis of the first control image and the initial control toner image.

5. An image forming apparatus according to claim 1, further comprising:

a developer exchange detecting portion configured to detect exchange of said developing portion or the developer, wherein the controller is configured to, when the exchange of said developing portion or the developer is detected by said developer exchange detecting portion, execute the initial operation without executing the operation in the mode irrespective of the exchange of said photosensitive member by said exchange detecting portion.

6. An image forming apparatus according to claim 1, further comprising an intermediary transfer member onto which the toner image is transferred from each of a plurality of photosensitive members, wherein said sensor is an optical sensor provided opposed to said intermediary transfer member at a position downstream of the plurality of photosensitive members with respect to a rotational direction of said intermediary transfer member.

7. An image forming apparatus according to claim 1, wherein said controller is configured to control the exposure condition for forming the supply control toner image, on the basis of the density information obtained by detecting the first control toner image and the second control toner image, so that the toner amount per unit area of the supply control toner image before the exchange of said photosensitive member and the toner amount per unit area of the supply control toner image after the exchange of said photosensitive member are equal to each other.

* * * * *